US005520738A

United States Patent [19]

Aindow et al.

[11] Patent Number: 5,520,738

[45] Date of Patent: May 28, 1996

[54] POWDER APPLICATOR DEVICE, PARTICULARLY FOR CIGARETTE MAKING MACHINES

[75] Inventors: Alan M. Aindow; Michael J. Cahill; John Dawson; James R. Stembridge, all of Coventry, United Kingdom

[73] Assignee: Molins PLC, Milton Keynes, England

[21] Appl. No.: 199,940

[22] Filed: Feb. 22, 1994

[30] Foreign Application Priority Data

Feb. 20, 1993 [GB] United Kingdom ..... 9303463

[51] Int. Cl.[6] ..... B05C 3/18

[52] U.S. Cl. ..... 118/621; 118/623; 118/626; 118/640; 118/696; 118/602; 118/104

[58] Field of Search ..... 118/621, 623, 118/626, 640, 696, 70, 602, 104, 308, 312; 427/457, 460, 469, 475, 482, 205; 131/284

[56] References Cited

U.S. PATENT DOCUMENTS

| | | | |
|---|---|---|---|
| 2,366,187 | 1/1945 | Friedwald | 131/284 |
| 3,316,876 | 5/1967 | McCombie | 118/50 |
| 3,380,436 | 4/1968 | Williamson et al. | 118/638 |
| 3,536,580 | 10/1970 | LaFave | 118/621 |
| 3,591,403 | 7/1971 | Sheehan | 427/463 |
| 3,653,758 | 4/1972 | Trimmer et al. | 427/469 |
| 3,868,925 | 3/1975 | Smith et al. | 118/621 |
| 3,970,035 | 7/1976 | Birckhead, Jr. | 118/312 |
| 4,324,198 | 4/1982 | Muz | 118/630 |
| 4,427,712 | 1/1984 | Pan | 427/460 |
| 4,797,686 | 1/1989 | Holder | 118/674 |
| 4,826,703 | 5/1989 | Kisler | 427/469 |
| 5,032,419 | 7/1991 | Lamirand et al. | 427/482 |
| 5,043,749 | 8/1991 | Punater et al. | 346/153.1 |

FOREIGN PATENT DOCUMENTS

| | | |
|---|---|---|
| 0233723A2 | 8/1987 | European Pat. Off. . |
| 0559453 | 9/1993 | European Pat. Off. . |
| 534251 | 2/1977 | U.S.S.R. . |
| 1562038 | 5/1980 | United Kingdom . |
| 2253578 | 9/1992 | United Kingdom . |

*Primary Examiner*—Laura Collins
*Attorney, Agent, or Firm*—Antonelli, Terry, Stout & Kraus

[57] ABSTRACT

A device for applying bronze or similar powder, particularly in a cigarette making machine, uses a corona discharge wire (36) or similar conductor maintained at high voltage to establish an electrostatic field which causes powder to be attracted to prepared adhesive patches on a paper web (14). Excess powder carried by the web is removed with the assistance of vibration, which may be produced by passing the web over an ultrasound device (44) or a pulsed air mover (102). Excess powder may also be removed by an air mover (152) directing a stream of air at the surface of the web carrying the powder.

18 Claims, 2 Drawing Sheets

PRINTER UNIT
37
44
48
46
42
16
34
32
36
17
14
11
35
28
38
30
22
12
24
18
40
20
10
26

170
46
44
34
36
62
14
38
28
52
60
54
56
50
58

78
44
80
34
108
36
74
108
60
38
82
62
14
70
28
86
84
72
76

POWDER APPLICATOR DEVICE, PARTICULARLY FOR CIGARETTE MAKING MACHINES

BACKGROUND OF THE INVENTION

This invention relates to a device for applying powder to a paper web, particularly in a cigarette making machine.

It is known to produce cigarettes in which the cigarette paper wrapper carries a printed legend (or motif), e.g. indicating the name of the brand or manufacturer. Such legends are sometimes required to have a metallic, coloured appearance, commonly simulating gold. Usually bronze powder is used: reference is made hereinafter to "bronze powder" without, however, limiting the type, including colour, of powder to which the invention is applicable.

Known devices for producing legends from bronze powder are usually mounted on the cigarette making machine, upstream of the position at which the cigarette paper is wrapped around the tobacco rod, and include a first section for applying an adhesive imprint to the paper and a second section for applying bronze powder to the paper so that it adheres to the adhesive imprint. Such known devices, which normally include mechanical means such as a roller for applying the powder to the paper and means such as brushes for removing excess applied powder, cannot operate at the speeds of the latest cigarette making machines (which can achieve production rates of 10,000 cigarettes/minute or more).

SUMMARY OF THE INVENTION

According to one aspect of the invention a device for applying powder to a moving paper web, particularly in a cigarette making machine, comprises means for providing prepared regions at predetermined positions on a surface of said web, means for defining a path for the web, means for supplying powder to a location adjacent the path of the web, means for establishing an electrostatic field in the region of said location so that powder is attracted to said surface of the web, and means for removing excess powder from the web, whereby the powder remains on the web substantially in said predetermined positions. In a preferred arrangement the establishing means comprises means maintained at a high electrical potential and located adjacent the opposite surface of the web. Such means preferably extends in the direction of said web, preferably adjacent the path of the portions of the web carrying said predetermined positions (e.g. having adhesive imprints), and conveniently comprises a corona discharge wire. In such arrangements means maintained at a relatively low electrical potential (e.g. an earth plate) is preferably arranged adjacent said surface of the web, so that said electrostatic field is established between said respective means maintained at high and low potentials. Any earth plate or the like used for this purpose will evidently be so shaped or arranged that it allows adequate access for powder to said surface of the web (e.g. the plate may be provided with one or more suitable apertures through which the powder may pass).

The supplying means may comprise a reservoir for powder, said location corresponding to an upper surface of powder in said reservoir. In a preferred arrangement the path of the paper web passes between said surface of said powder and said establishing means. Alternatively, powder could be supplied to said path somewhat upstream of the establishing means, and be conveyed to said location with the web (e.g. by air flowing with the web). The supply means may be arranged to supply powder at a rate which is related to web speed, and/or so that the surface of powder in said reservoir remains approximately constant.

The amount or density of powder applied to the web may be controlled by varying the intensity of the electrostatic field (e.g. by increasing the voltage of means establishing the field so as to increase the density) or by varying or changing the length of the path of the web along which it is subjected to the electrostatic field. In order to maintain a desired application rate at higher paper web speeds it may be necessary to increase the intensity of the electrostatic field and/or increase the length of the path along which powder is applied. This type of control could be automated, e.g. by arranging for a voltage generating the electrostatic field to be increased with speed of the web.

Where the predetermined positions on the web, e.g. those positions carrying adhesive imprints, are regularly spaced, as will usually be the case where the web is intended for cigarette wrapping, the intensity of the electrostatic field could be pulsed synchronously with the passage of those positions past said location, so that powder is attracted only (or mainly) where it is required. Thus a voltage applied to generate the electrostatic field could be varied synchronously with operation of a device (e.g. an adhesive printer) determining said positions on the web.

Excess powder is preferably removed by or with the assistance of vibration. Such vibration may be generated by an ultrasound device. According to another aspect of the invention, therefore, excess powder applied to a paper web in a powder applicator device is removed by or with the assistance of ultrasound. The path of the paper web may pass over the end of an ultrasonic horn. In a preferred arrangement the path has a direction change defined by the trailing edge of an ultrasonic horn: this ensures good contact with the paper and hence good transmission of the ultrasound.

According to a further aspect of the invention excess powder is removed from a web by or with the assistance of an air mover, which may supply a substantially continuous or a pulsed air stream. The stream may be directed adjacent the surface of the web carrying the powder or, particularly where the stream is pulsed, against the opposite side of the web, so that excess powder is removed with the assistance of vibration generated by the stream. The air mover may comprise an air outlet in a guide surface for the web.

Excess powder removed from the paper web is preferably recirculated to the supply means. The device may include a reservoir from which the powder is withdrawn by the supplying means and to which excess powder is returned. Means may be provided for encouraging circulation of removed excess powder to the supplying means: such means may use gravity, e.g. by arranging for the reservoir to be appropriately inclined, or may employ vibration or use an air flow entraining powder. Suction means may be provided for collecting excess powder removed from the web.

BRIEF DESCRIPTION OF THE DRAWINGS

The invention will be further described, by way of example only, with reference to the accompanying diagrammatic drawings, in which.

DETAILED DESCRIPTION OF THE PREFERRED EMBODIMENTS

Figure 1:
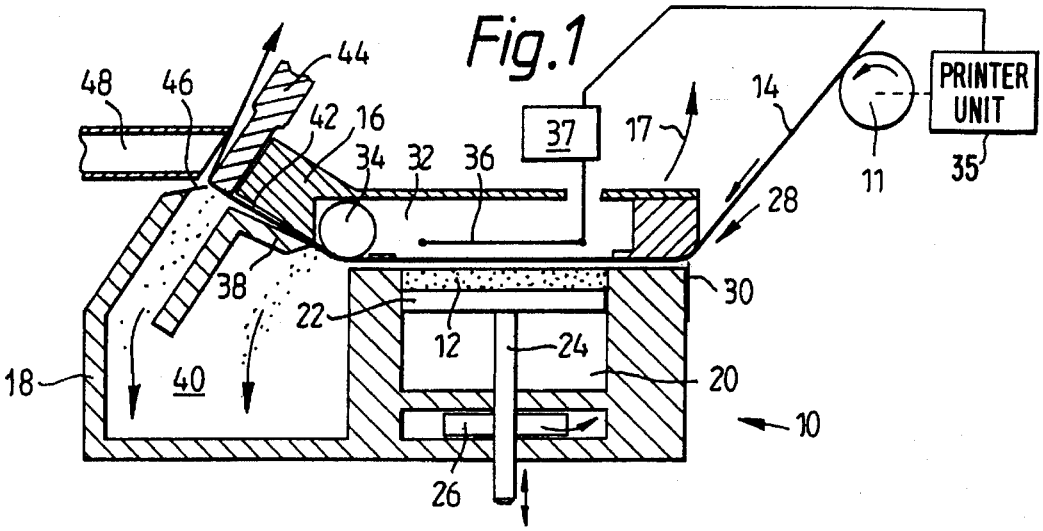
FIGS. 1, 2 and 3 are respectively sectional side views of first, second and third versions of an applicator unit for applying bronze powder to a cigarette paper web.

FIG. 1 shows an applicator unit 10 for applying bronze powder 12 to a web 14 of cigarette paper. The unit 10 is located on a cigarette making machine so that the web 14 is withdrawn from a reel, passes through the unit, and then proceeds towards the garniture of the machine at which it is wrapped around a stream of tobacco to form a continuous cigarette rod. Upstream of the unit 10 at a printing unit 35 having a printing roller 11 the paper is provided with a prepared region, such as by printing on its undersurface with a pattern of adhesive corresponding to the legend or motif required to carry bronze powder. Other printing units, for providing other prepared regions, such as by applying different colour legends or motifs in different locations on the cigarette paper, may be located adjacent the unit 10.

The unit 10 has an upper assembly 16 defining a path for the web 14 through the unit and a lower assembly 18 containing a reservoir 20 for the bronze powder 12. The upper assembly 16 is displaceable, e.g. by swinging upwards as indicated by the arrow 17, so as to facilitate threading of the web 14 through the unit 10. The reservoir 20 contains a piston 22 connected to a threaded rod 24 movable by means of a thumb-wheel 26 in order to maintain the level of bronze powder 12 approximately at the top of the reservoir. Movement of the piston 22 could be automated, e.g. by connecting a motorised drive to the rod 24.

The paper web 14 passes through a narrow slot forming an entrance 28 between the upper and lower assemblies 18, 20. An entry blade 30 extending upwards from the assembly 18 further restricts the entrance 28 and reduces any tendency for bronze powder 12 to escape from the unit 10 through the entrance. The web 14 extends below a recess 32 in the upper assembly 16 between the entrance 28 and an idler roll 34, and follows a straight path on which it is closely spaced above the surface level of bronze powder 12 in the reservoir 20. Typically the average spacing between the web 14 and the bronze powder 12 in the reservoir 20 is about 5 mm. In the recess 32, above the reservoir 12, is a corona discharge wire 36 extending parallel to the path of the web 14 and located in a lateral position which is generally central relative to that part of the web carrying the printed adhesive. The wire 36 is maintained at a positive electrical potential in the region of 7–12 kV; it has a length of about 60 mm, a diameter of about 0.1 mm, and is spaced at a distance of about 10 mm above the web 14. The body of the lower assembly 18 surrounding the reservoir 20 is constructed of conducting material and is electrically earthed.

Downstream of the roller 34 the web 14 passes through a narrow gap (typically about 0.2 mm) between a lower surface of the assembly 6 and a primary blade 38. Excess bronze powder 12 removed from the web 14 by the blade 38 is collected in a chamber 40 in the lower assembly 18. Beyond the blade 38 the web passes over a lead-in wedge 42 and an end surface of an ultrasonic horn 44. The ultrasonic horn 44 typically produces ultrasound vibrations at a frequency of 35 kHz with an amplitude of 0.025–0.04 mm. A suitable unit is available from FFR Ultrasonics, of Queniborough, Leicestershire, LE7 8FP, UK, under the type designation Delta 8935HGN. Ultrasonic horns having lower resonant frequencies are also effective, although an increased amplitude may be desirable (e.g. 0.08 mm at 20 kHz).

An exit blade 46 extends close to the downstream edge of the ultrasonic horn 44 from which the web 14 exits the unit 10. A suction conduit 48 is arranged close to the exit region, to minimise atmospheric contamination by loose bronze powder leaving the unit 10 with the web 14.

In operation, with web 14 passing through the unit at up to 10 m/sec, equivalent to a cigarette making machine speed of 10,000 cigarettes/minute, the upper surface of the web is sprayed with electrical charge by the corona wire 36, thereby causing bronze powder 12 to be attracted to the undersurface of the web by electrostatic attraction. The electrostatic field intensity and the resultant effectiveness of the attraction of the bronze powder are enhanced by providing an electrically earthed surface on the opposite side of the web. This could comprise the upper surface of the part of the lower assembly 18 surrounding the reservoir 20 or could comprise a separate earth plate or grid located between the reservoir and the path of the web, the plate or grid having one or more apertures to allow bronze powder to pass from the reservoir to the web.

The quantity of bronze powder 12 attracted to the web 14 and the resultant density on the web can be controlled by varying the voltage applied to the corona discharge wire 36, e.g. by means of a controller 37. Alternatively, or additionally, this quantity can be controlled by varying the length of the wire 36. The action of the electrostatic charge on the paper 14 in attracting the bronze powder 12 may be assisted by some fluidisation of the upper surface of the bronze powder in the reservoir 20 caused by air moving with the paper web.

Typically 80% of the excess bronze powder applied to the web 14 is removed by the primary blade 38. Substantially all of the remainder of the excess is removed by vibration as the web 14 passes over the ultrasound horn 44. Causing the web 14 to bend around the trailing edge of the horn 44 is helpful in ensuring intimate contact between the web and the horn. Excess bronze powder, which is removed from printed and non-printed areas of the web, is collected in the chamber 40, from where it may be re-supplied to the reservoir 20.

Figure 2:
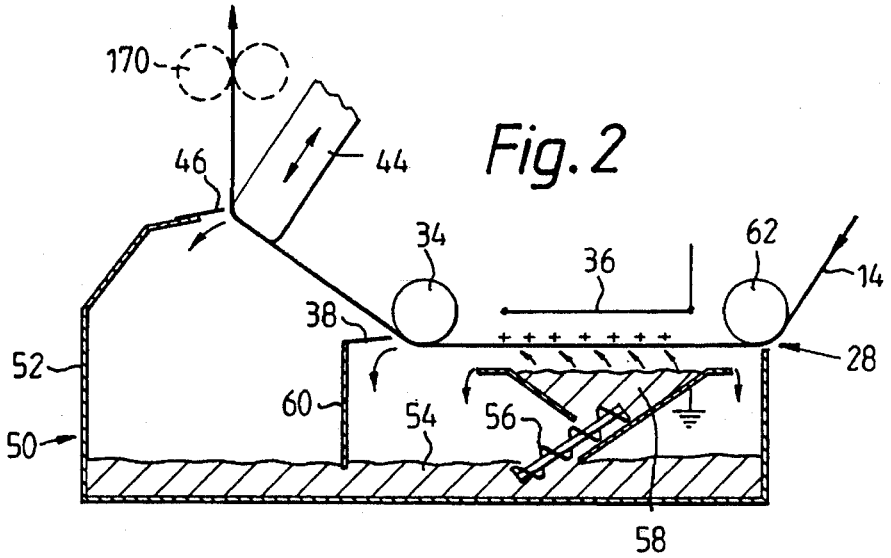

FIG. 2 shows a second applicator unit 50, which is similar in many respects to the unit 10 of FIG. 1: similar parts have been given similar reference numbers. The main difference is that the unit 50 has provision for internal recirculation of excess bronze powder removed by the blades 38 and 46 and under action of the ultrasonic horn 44. The unit 50 includes a modified lower assembly 52 with a reservoir 54 for bronze powder 12 extending along the whole of the lower portion of the assembly. The reservoir 54 collects excess bronze powder and a motorised Archimedes screw 56 elevates powder to an earthed hopper 58 from which it is attracted to the web 14 in the same way as in the unit 10. The reservoir 54 is refilled from an external source as required. The Archimedes screw 56 may be connected to a drive whose speed varies with the speed of the paper web 14.

The blade 38 has an integral baffle 60 extending down to a position near the bottom of the reservoir 54: this baffle tends to prevent undesirable entrainment and further unnecessary recirculation within the reservoir of excess powder removed by the blade. A further difference between the units 10 and 50 is that the unit 50 has a roller 62 around which the web 14 passes at its entrance 28.

The unit 50 could be inclined, so that gravity assists movement of bronze powder 12 in the reservoir 54 in a direction from the region in which it is collected to the region in which it is elevated by the Archimedes screw 56, i.e. from left to right as shown in FIG. 2.

Instead of providing a hopper 58, which in effect forms a subsidiary part of the reservoir 54, the unit 50 could be modified so that the level of bronze powder in the reservoir 54 is maintained at the same level as that of the hopper 58, and so that the powder is attracted directly from the reservoir 54. This has the advantage that bronze powder could be supplied to the reservoir substantially at the rate of usage, thereby minimising working of the powder (which can result in reduction in its flowability). By way of explanation, the Archimedes screw 56 has to supply powder at a rate very much higher than the rate of use: as little as 2% of the powder supplied may be carried away from the unit 50 on the web 14. If the reservoir 54 is modified so that it provides a powder level from which the web 14 can attract powder directly it may be preferable to incline the unit 50 so that gravity assists movement of excess powder to the region below the corona discharge wire 36. A perforated screen could be provided over the powder in the region of the wire 36: this would allow powder to be attracted to the paper web 14 but would otherwise inhibit flow and would assist in defining the required level of powder in that region.

Figure 3:
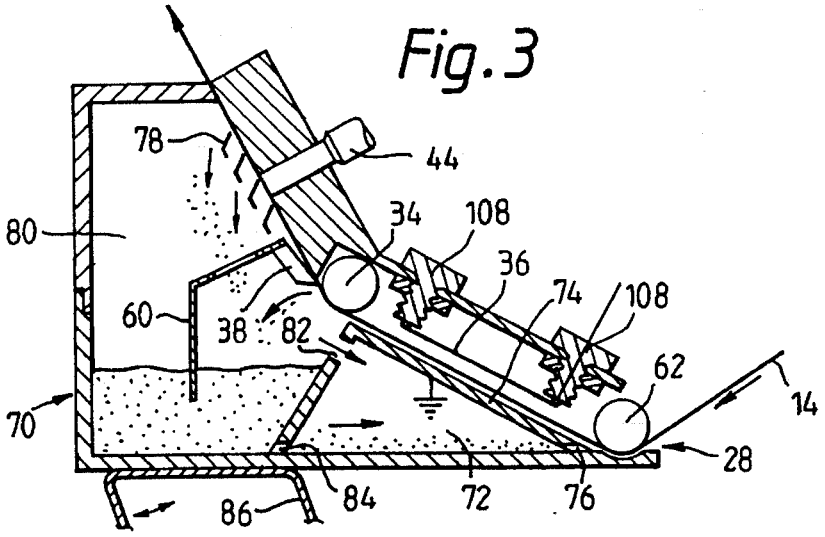

FIG. 3 shows a third bronze powder applicator unit 70: again similar parts have been given similar reference numbers. The unit 70 has a first bronze powder chamber 72 having an inclined surface 74 extending parallel and closely adjacent to the path of the paper web 14 opposite the corona discharge unit 36. The chamber 72 has an exit 76 for powder near the roller, 62 at the entrance 28 of the unit 70. In the region of the ultrasonic horn 44 a series of secondary blades 78 supplements the action of the primary blade 38 in removing excess bronze powder applied to the web 14. A second chamber 80 collects the excess bronze powder removed from the web. Upper and lower inlets 82, 84 allow passage of bronze powder from the chamber 80 into the chamber 72. The unit 70 is mounted on a vibrating tray feeder 86: a suitable feeder is available from SIG Packaging Technology (UK) Limited, of Derby, DE21 4SY, UK, under the type designation FTOB.

In operation, the feeder 86 vibrates the unit 70 so that bronze powder is advanced to the right as viewed in the drawing. Bronze powder reaching the exit 76 of the chamber 72 is carried with the web 14 and entrained air and is attracted to the web electrostatically as it passes between the web and surface 74. Excess powder removed by the blades 38 and 78 and under the action of the ultrasonic horn 44 is collected in the chamber 80, from which it is advanced to the chamber 72 by way of inlets 82 and/or 84 under action of the feeder 86. Recirculation of bronze powder in the unit 70 may also be assisted by circulation of air carried into the chamber 80 by the moving web 14 and exiting through the chamber 72 and exit 76.

The blades 78 could be replaced by one or more vanes having a curved end which, unlike the blades 38 and 78, are arranged to run in very light contact with the web 14. The curved end of the vane could have an aperture extending partly across its width in a position corresponding to that of the print on the web 14 and through which removed excess bronze powder passes to the reservoir of bronze powder in the chamber 80.

The end of the ultrasonic horn 44 could project beyond its mounting surface, so that the web 14 makes better contact with it. A wedge-shaped lead-in portion similar to the portion 42 in the unit 10 could guide the web over the horn 44. A trailing wedge-shaped web guide could be added downstream of the ultrasonic horn 44. One of the vanes 78 has a blade closely adjacent to the trailing edge of the horn 44: such an arrangement, which is also present in the units 10 and 50, has been found particularly effective in removing excess bronze powder from the web 14.

Figure 4:
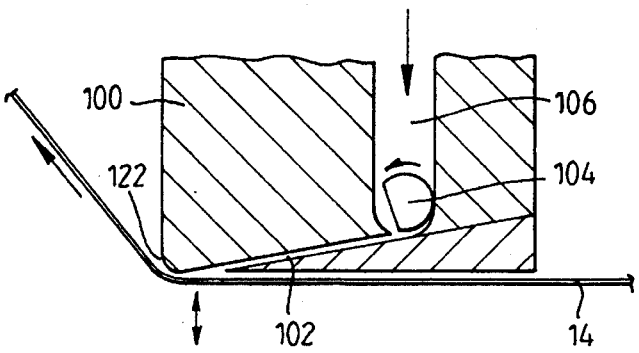
FIG. 4 is a sectional side view of a web guide for a bronze powder applicator unit.
Figure 6:
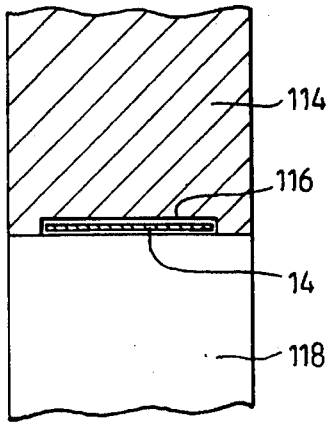
FIG. 6 is a sectional view of part of a sealing arrangement for a bronze powder applicator unit.

As an alternative or supplement to stationary blades or vanes and/or the ultrasonic horn, pneumatic systems may be used to assist in removal of excess powder from the web. Thus, an air mover mounted adjacent the path of the web and directing an air stream at the printed surface is effective at removing excess powder. Alternatively, as shown in FIG. 4, the paper web 14 could be caused to pass over a body 100 having an air exit slot 102, similar to that of an air mover, to which a pulsating air supply is applied, by means of a rotary valve 104 located in an air supply passage 106 connected to the slot. The pulsating air supply causes the paper web 14 to vibrate and hence release excess powder. The body 100 could replace or supplement the ultrasonic horn 44 in any of the units 10, 50 and 70. Note that the air mover exit slot 102 is located adjacent the trailing edge 122 of the body 100. The guidance of the web 14 over the edge 122 ensures that it is always maintained in proximity to the slot 102. The valve 104 could be omitted so that the air supply can be continuous.

The corona discharge wire 36 is to an extent self-cleaning, as it sprays any approaching powder with a positive charge and so repels the powder by its own positive potential. However, supplementary provision against contamination and eventual short circuiting may be provided by supporting the wire 36 with deeply-convoluted insulating stand-offs 108. Baffles and/or an associated purging air flow path may also be used to protect the wire 36.

In order to minimise air-borne powder leaving any of the units 10, 50 and 70, adequate sealing is important. For this purpose a body 114 carrying the ultrasonic horn 44 (or replacing body 100) may be provided with a shallow recess 116 in which the paper web 14 runs. One or more flexible sealing blades 118 spaced longitudinally in the direction of movement of the web 14 may engage the body 114 so that the only gap for possible escape of powder is by way of the recess 116. However, while it is desirable that the recess 116 should be as shallow as possible, its depth should not be less than about three times the thickness of the web 14 (about 0.05 mm) if the web is not to snag on the blades 118. In addition to sealing, the blades 118 assist in removal of excess powder and may supplement (or replace) the blades or vanes 38, 46 or 78.

In the described embodiments the wire 36 may be maintained at a reasonably constant voltage, although relatively long term variations may be applied to adjust the density of the applied powder. The adhesive pattern applied to the web 14 usually occurs in regular longitudinally-spaced regions, however. The voltage applied to the wire 36 could be pulsed and synchronised with the passage of the web by a signal received from the adhesive printer 35, e.g. under control of the controller 37, so that the wire is maintained at high voltage only during such periods as a portion of the web on which it is required to receive bronze powder is opposite the wire. In this way powder is attracted only (or mainly) to those positions of the web on which it is required (i.e. where the adhesive is printed), thereby reducing the rate of initial application of bronze powder more nearly to that required to be retained by the web 14.

The rate of use of bronze powder will vary with the speed of the machine, i.e. with the speed of the paper web 14. The rate of application of powder may be varied in proportion to said speed, so that for example the Archimedes screw 56 could be geared to machine speed. Similarly, in order to increase application rate, the voltage applied to the discharge wire 36 and/or the length of the wire may be increased. The voltage, in particular, could be arranged to vary automatically with machine speed. The controller 37, which may for example include a microprocessor, may perform any or all of these functions, and may for example be responsive to the signal received from the printing unit 35 for detecting web speed.

Figure 5:
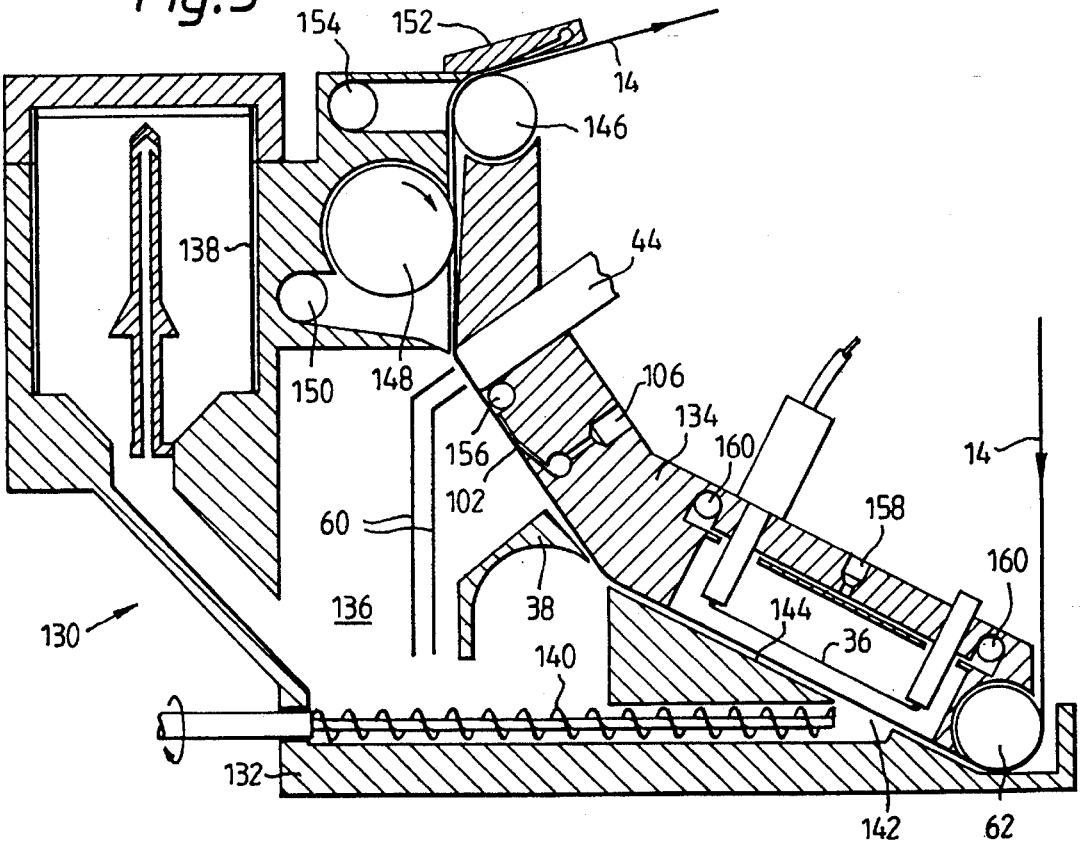
FIG. 5 is a sectional side view of another bronze powder applicator unit.

FIG. 5 shows a further bronze powder applicator unit 130. This embodies parts similar to those already described with reference to one or more of FIGS. 1–4: similar reference numbers have been used for such parts in FIG. 5, generally without further description. The unit 130 has a lower assembly 132 and an upper assembly 134. The lower assembly 132 contains a bronze powder reservoir 136 and provision for replenishing the reservoir from a replaceable canister 138. A feed auger (Archimedes screw) 140 advances bronze powder to an outlet 142 opposite the corona discharge wire 36. Bronze powder is attracted to the web 14 from the outlet 142 and as it is carried with the web past an inclined surface 144 opposite the wire 36: in this respect the arrangement of the unit 130 is similar to that of the unit 70 of FIG. 3.

The upper assembly 134 includes an air exit slot 102 (similar to that of FIG. 4) and an ultrasonic horn 44. Either or both of these may be used to assist in excess powder removal. At its downstream end the upper assembly carries a roller 146. In its run between the region of the ultrasonic horn and the roller 146 the web 14 makes light contact with a knurled wheel 148 carried in the lower assembly 132. Bronze powder removed by the wheel 148 is collected by a suction waste pipe 150. The unit 130 may be modified to omit the wheel 148.

Beyond the roller 146 the web 14 passes over a final air mover 152, which directs a stream of air at the bronze-carrying surface of the web. Excess powder still remaining on the web 14 is directed by this air stream to a suction waste pipe 154.

A suction pipe 156 is also provided in the vicinity of the air exit slot 102, to collect air delivered through the slot, and a pressure air supply connection 158 and further suction inlet 160 are provided in the region of the corona discharge wire 36.

In order to prevent excessive ultrasound vibration being directed into the body of the upper assembly 134 the ultrasonic horn 44 is spaced slightly from the surrounding part of the assembly (not apparent in the drawing). The spaces are preferably sealed using a material or type of seal which is poor at conducting ultrasound (e.g. a nylon brush seal).

Since the units 10, 50, 70 and 130 substantially or entirely avoid mechanical contact with the adhesive print on the web 14 any requirement, common with known applicator units, to use particularly viscous adhesives which withstand mechanical rubbing without smudging does not apply. Thus, adhesives not commonly used in association with bronze applicator units may be used, e.g. PVA-based adhesives. Drying means for such adhesives could be located immediately downstream of the applicator unit. A further advantage of a non-contact method of applying bronze powder is that there are fewer mechanical parts (rollers etc.) susceptible to clogging with adhesive, and there is less likelihood of bronze powder becoming embedded in the paper web 14 and so being difficult to remove from areas where it is not required.

Other advantages associated with applicator units as disclosed are that they are capable of operating at higher speeds than have previously been usual (on machines running at up to 10,000 cigarettes/minute or more); and powder can be applied in high and controllable densities with good removal of excess powder irrespective of paper surface texture.

The use of the described apparatus is not restricted to application of bronze powder. For example, it is known, e.g. from European patent specification No. 559453A, to add burn inhibiting material to a cigarette wrapper web at regular intervals. Such material, e.g. micro-crystalline cellulose, in powdered form could be applied using the present apparatus. The material could be secured to the paper web by an adhesive pattern and/or by pressing the powder onto the paper, e.g. by use of rollers 170 as shown in FIG. 2. Rollers such as the rollers 170 could in principle be located within any of the chambers 10, 50, 70 and 130.

We claim:

1. A device for applying powder to a moving paper web, comprising means for providing prepared regions at predetermined positions on a surface of said web, said prepared regions being capable of retaining powder on the web at said predetermined position; means defining a path for the web; means for supplying powder to a location adjacent said path; means for establishing an electrostatic field in a region including said location so that powder is attracted to said surface of the web; and means including an ultrasonic device for removing excess powder from the web, said path defining means being arranged so that said web is entrained over a part of said ultrasonic device so as to contact said part with the surface of said web opposite the surface on which said prepared regions are provided, said part of said ultrasonic device including an edge over which the web is entrained and at which said path changes direction, whereby excess powder is removed from said web by or with the assistance of ultrasonic vibration transmitted to said web by said ultrasonic device, so that powder remains on the web substantially only in said predetermined positions.

2. A device as claimed in claim 1, wherein said establishing means comprises conductor means for maintaining a high electrical potential adjacent said path.

3. A device as claimed in claim 2, wherein said conductor means comprises means extending in the direction of said path.

4. A device as claimed in claim 3, wherein said conductor means comprises a corona discharge wire.

5. A device as claimed in claim 2, wherein said conductor means is located on a first side of said path, and said supplying means is located on a second side of said path, further including means maintained at low electrical potential adjacent the second side of said path.

6. A device as claimed in claim 1, wherein said location and said establishing means are arranged on opposite sides of said path.

7. A device as claimed in claim 1, wherein said supplying means includes means arranged to supply powder at a rate which is related to speed of the web.

8. A device as claimed in claim 1, further including means for controlling said establishing means so as to vary the intensity of said electrostatic field.

9. A device as claimed in claim 8, wherein said controlling means comprises means responsive to variation in speed of the web.

10. A device as claimed in claim 8, wherein said controlling means comprises means synchronised with said means for providing prepared regions, so that the intensity of said electrostatic field is varied in such a manner that powder is attracted to said predetermined positions on the web.

11. A device as claimed in claim 1, wherein said removing means further includes an air mover.

12. A device as claimed in claim 11, wherein said air mover includes means for directing an air stream at said surface of the web.

13. A device as claimed in claim 11, wherein said air mover includes means for directing an air stream adjacent said path on the side opposite said surface of the web and in the direction of movement of the web.

14. A device as claimed in claim 13, wherein said air mover includes means for directing a pulsed stream of air.

15. A device as claimed in claim 11, wherein said air mover comprises an air outlet located in a guide surface, said guide surface forming part of said path defining means.

16. A device as claimed in claim 1, wherein said supplying means includes means defining a flow path for powder, said removing means further including means for returning excess powder to said flow path.

17. A device for applying powder to a moving paper web, comprising means for providing prepared regions at predetermined positions on a surface of said web, said prepared regions being capable of retaining powder on the web at said predetermined position; means defining a path for the web; means for supplying powder to a location adjacent said path so that powder is applied to said surface of the web; and means including an ultrasonic device for removing excess powder from the web by or with the assistance of ultrasound, said path defining means being arranged so that said web is entrained over a part of said ultrasonic device so as to contact said part with the surface of said web opposite the surface on which said prepared regions are provided, said part of said ultrasonic device including an edge over which the web is entrained and at which said path changes direction, whereby excess powder is removed from said web by or with the assistance of ultrasonic vibration transmitted to said web by said ultrasonic device, so that powder remains on the web substantially only in said predetermined positions.

18. A device as claimed in claim 17, wherein said part of said ultrasonic device includes a recess through which said path passes, further including blade means extending across said recess and engaging said part at positions spaced laterally of said recess, so that said blade means and said recess define a closed periphery through which said path passes.

* * * * *